US005495931A

United States Patent [19]

Meyer-Steffens et al.

[11] Patent Number: 5,495,931

[45] Date of Patent: Mar. 5, 1996

[54] METHOD AND APPARATUS FOR CALIBRATING A COIN CHECKING DEVICE

[75] Inventors: Klaus Meyer-Steffens, Deinste; Manfred Gröhlich, Buxtehude, both of Germany

[73] Assignee: National Rejectors Inc. GmbH, Buxtehude, Germany

[21] Appl. No.: 130,356

[22] Filed: Oct. 1, 1993

[30] Foreign Application Priority Data

Oct. 2, 1992 [DE] Germany ..... 42 33 194.3

[51] Int. Cl.[6] ..... G07D 5/08

[52] U.S. Cl. ..... 194/317; 194/214; 324/601

[58] Field of Search ..... 194/317, 318, 194/319, 214, 353; 324/601

[56] References Cited

U.S. PATENT DOCUMENTS

| | | | |
|---|---|---|---|
| 4,662,501 | 5/1987 | Partridge | 194/319 |
| 4,674,618 | 6/1987 | Eglise et al. | 194/214 X |
| 4,926,996 | 5/1990 | Eglise et al. | 194/214 X |
| 5,056,644 | 10/1991 | Parker | 194/318 |
| 5,067,604 | 11/1991 | Metcalf | 194/317 X |
| 5,083,652 | 1/1992 | Kobayashi et al. | 194/318 |

FOREIGN PATENT DOCUMENTS

| | | | |
|---|---|---|---|
| 0072189 | 12/1986 | European Pat. Off. . | |
| 4205909 | 9/1992 | Germany | 194/317 |

OTHER PUBLICATIONS

Official Action issued in parent German patent application P 42 33 194.3 with article reference *"High–Accuracy, Simultaneous Calibration of Signal Measuring Systems"*, by B. K. Sternberg & R. W. Nopper, from Meas. Sci. Technol. 1 (1990) 225–230.

*Primary Examiner*—Frank E. Werner
*Assistant Examiner*—Scott L. Lowe
*Attorney, Agent, or Firm*—Vidas, Arrett & Steinkraus

[57] ABSTRACT

A method for calibrating a coin checking device includes inserting a calibrating module into a coin passage. The coin passage contains at least one coin sensor for determining a coin's physical features. The calibrating module generates measuring signals which simulate an acceptable coin's presence. The measuring signals are received by the at least one coin sensor which in turn outputs sensor signals. The measuring signals and the sensor signals are used to calculate a calibration factor for the coin checking device.

15 Claims, 2 Drawing Sheets

METHOD AND APPARATUS FOR CALIBRATING A COIN CHECKING DEVICE

BACKGROUND OF THE INVENTION

The present invention relates to a method for calibrating a coin checking device comprising at least a sensor.

A coin checking device determines certain features of coins which have been inserted, such as the material, dimensions such as thickness and diameter, light transmitting features, the edge relief and stamping gravure, the weight, the hardness and so on. The materials are typically checked by means of induction coils which magnetic field coacts with the coin material. The coins affect a typical attenuation in the induction sensors, wherein the amount of attenuation indicates the material or the alloy of the coin to be checked. The light transmission of a coin or the relief are mostly checked by optical sensors. A light source illuminates the edge or the surface of the coin and a light electrical receiver receives the pass-through or reflected light to test certain geometrical features of the coin. It is further known to determine the weight or the mass of discs inserted by weighing means or impact sensors. The pulse which is generated by the coin impacting an impact element is characteristical for the mass and thus the weight of the coin. Even the hardness of the coin material may be determined by an impact measurement. The pulse diagram resulting from the impact of a coin on an impact element is an indication for the hardness of the coin.

The known coin checking devices are suited to check a number of different coins. They include a microprocessor and a RAM memory to be loaded with reference values to be compared with sensed values. To accomodate tolerances, it is conventional to provide an upper and a lower reference value for each coin thus defining a so-called admittance band. Before a coin checking device is utilized the reference values have to be loaded in accordance with the coins which should be tested by the device. Theoretically, it is possible to mathematically calculate the reference values, but in practical use this method is not sufficiently accurate. The mechanical and electrical features of a coin checking device are subjected to more or less substantial variations which are mostly due to manufacturing processes. Up to now, it has been considered to be necessary to determine and to programm the reference values specifically for each device.

It is known to conduct a calibrating process of this type by using testing coins. Selected genuine coins having features which are distributed within the acceptance band are inserted into the device to be calibrated. Based on the sensor signals obtained, the reference values are determined and stored. As the testing coins wear in response to time, they have to be replaced by new coins. This turns out to be complicated and difficult. It is also known to use tokens instead of testing coins, such tokens having analog physical features and being made specially for purposes of testing. The method for making tokens, however, is relatively costly.

EP 0 072 189 discloses a method for calibrating coin checking devices using two tokens for each coin set of a certain currency to generate parameter signals. Both the parameter signals characterize the coordinates of a measuring point (angle and length of a point in the vector diagram of electromagnetical behaviour). The parameter signals indicate the mechanical and electrical behaviour of a specific coin checking device during the passage of coins independent from the coin value. The parameter signals are used to calculate calibrating factors to be applied to standard reference values. By means of a proper algorithm the standard reference values are converted to determine reference values to be specific for the device. These reference values are then loaded into the RAM memory of the device. The known method needs less testing coins, but still needs a number of coins. A further drawback is seen in that the reference values are read into the memory during the checking phase. When a coin checking device is being manufactured, it is regularly not known for which currency and thus for which coins it will be used. Accordingly, the device should be calibrated in a late manufacturing process after the particular currency and the particular coins to be tested have become known. Based on manufacturing costs it is preferred that the calibrating process be performed while manufacturing the device.

SUMMARY OF THE INVENTION

It is an object of the invention to provide a method for calibrating a coin checking device comprising at least a sensor that eliminates the need for testing coins and can be performed in a simple and fast manner.

The present invention is based on the recognition that the sensors provided in the coin checking device coact with the passing coin to be tested. The material of the coin affects the electromagnetic field of a pair of coils, for example. A coin passes through one or two light traps. Accordingly, when a coin passes a pair of distant light traps, this is an indication of the diameter of a coin. The invention is further based on the recognition that the action to which the sensors are subjected by a coin passing through the device can be simulated. According to the invention a calibrating module is inserted in the coin passage where the sensor is located to generate a sensor signal. The calibrating module coacts with the sensor offering to the sensor the physical feature to which the sensor shall be responsive. In other words, the calibrating module is "seen" by the sensor like a coin, but there is no coin in reality, as the module has a physical feature which is identical with or similar to a coin. It is not required to produce the same effect as a coin would produce, as the "behavior" of the sensor shall be determined which is typical to the sensor and is independent from the "disturbance variable" initiating the sensor signal.

It should be understood that a sequence of operations may be generated by the calibrating module to generate a corresponding sequence of sensor signals. In each case, at least one sensor signal is calculated for a reference value characteristic for the coin testing device, for example, a calibrating factor is determined from the sensor signal which is multiplied with a standard reference value.

According to an embodiment of the invention, the time responsive simulation signal simulating the physical feature corresponds to the temporary course of the sensor signal generated by a proper coin. The calibrating module generates a simulation signal which results in a measuring signal such that the sensor practically reacts like a proper coin would react. Selectively, the simulation signal may have a different magnitude and an altered course. In this case, the sensor signals generated by the sensor may be processed in a similar way as the prior art above referred to teaching using discs or coins which differ from a genuine coin. In this case, the sensor signals define calibrating factors for calculating the reference values.

The method according to the invention has the same advantages as the prior art just referred to, but has a further advantage in that testing discs or testing coins are not anymore required. There is the further advantage that the method may be conducted very rapidly and simply. Still further, the calibration is not affected by the running disturbances which are inherent to testing coins which even can be polygonal. The running disturbances require the testing coin to be inserted a number of times which results in higher wear and increased time. Still further, the simulation signals may be altered in any manner by means of the calibrating module to provide a corresponding accomodation to the behaviour of the coin checking device, or respectively the sensors as well as a calibration valid for a different set of coins.

Particularly preferred aspects of the method according to the invention provide for storing the measuring values corresponding to the sensor signals in a RAM memory, for storing correlation-functions corresponding to desired proper coins in a RAM memory of an external computer, for calculating the reference value for a desired acceptable coin from the sensor signal by means of one of the correlation functions, and for storing the reference value in the RAM memory of the coin checking device. According to this method, all coin checking devices can be initially programmed with parameter signals generated by the calibrating module while being still in production. Accordingly, some kind of a standard calibration is performed. In a second step of production which may be separate in space and time with respect to the first one, the values loaded in the RAM memory may be read into a computer which calculates the individual reference values for proper coins by means of a data memory. The correlation functions are stored in the data memory which are required to convert the parameter signals to reference signals. The data memory further receives the external information regarding which coins should be accepted by the coin checking device in which passage, whether the accepting ranges should be adjusted wide or narrow or so on. The converting algorithms may be empirically determined. According to this method, all coin checking devices are first programmed identically and in a second step they are adapted or matched to the respective set of coins as the respective currency requires.

Typically, a coin tester computes a number of sensors. According to the invention, it is proposed that for each sensor at least a sensor signal is produced. The temporary sequence of the sensor signals should approximately correspond to the course of time in which the coin passes the sensors.

It is a further object of the present invention to provide a device which is capable to calibrate a coin checking device in which test coins are not used.

According to the invention the dimensions of the calibrating module are selected such that it can be inserted in the coin passage where the sensors are located. For example, the width of the module approximately corresponds to the thickness of the maximum thickness of a proper coin. The calibrating module will be fixed in a predetermined position in the passage, wherein this position must be reproduced to obtain the same position for all coin testers. The calibrating module includes at least a simulation section which is controlled by a simulation generator. According to an embodiment of the invention the simulation generator is located external of the coin passage, preferably external of the coin tester and is connected with the simulation section through controller conduits. Preferably the position of the simulation section in the coin passage is coincident with that of the sensor. According to the invention the simulation section may be adjustable, for example to calibrate coins having different diameters.

When the electromagnetical behavior of a coin is to be simulated, the invention provides for a simulation means having at least a magnetic coil, preferably a coreless coil to generate an electromagnetical field. The simulation generator may be designed for this type of simulation such that different signal shapes in response to time and amplitude are generated, for example a sine wave, a rectangular wave and so on. According to another embodiment of the invention the control signal may be amplitude modulated and the modulation period may be in the range of the passing period of a coin through the electromagnetical field of the coil of the coin tester.

However, when the optical behavior of a coin is to be simulated with respect to an optical sensor, the simulation means may include an adjustable aperture. Opening and closing the aperture may simulate the passing of a coin through a light barrier. Still further the simulation means may include an adjustable reflecting means which simulates the passage of a certain relief of the coin to be tested to the photoelectrical receiver.

When a testing for hardness of a coin is to be simulated, the invention provides for a simulation means having an adjustable impact element. This impact element is moved with a predetermined energy against a counterelement which corresponds to the procedure to which a genuine coin to be tested is subjected. In a similar way the simulation means may include an adjustable mass element which is weighed for example by a weighing device or which cooperates with a counterelement to determine the mass.

BRIEF DESCRIPTION OF THE DRAWINGS

Other advantages and features of the invention will appear from the following description of a non-limiting embodiment with reference to the Figures which show.

DETAILED DESCRIPTION OF THE INVENTION

Figure 1:
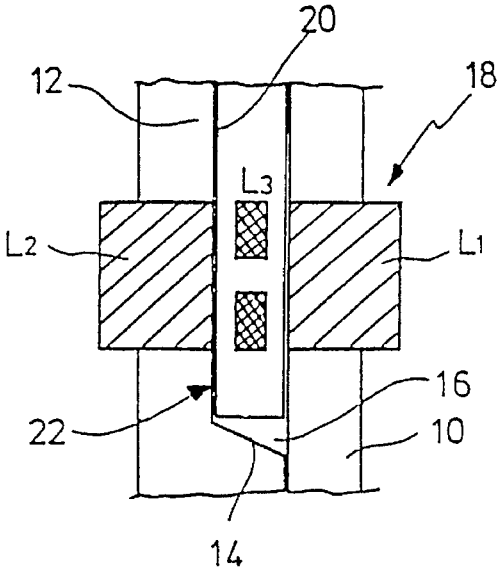
FIG. 1 a schematical section of a calibrating module according to the invention in a coin passage section, FIG. 2 a diagram of the coaction of the calibrating module coils and an electromagnetical sensor, FIG. 3 a perspective view of the calibrating module of FIG. 1, and FIG. 4 a general block diagram of the calibrating module containing the simulation means.

FIG. 1 shows a support plate 10 of a coin tester which is not shown. The support plate 10 in combination with a track support plate 12 and a track means 14 define a coin passage 16 through which the coins inserted pass. The coin passage 16 accomodates a number of sensors of which one sensor 18 is shown in FIG. 1. The sensor comprises a pair of coils L1 and L2 one of which each is fixed to the support plate 10 and the track support plate 12. It should be understood that an alternative embodiment of a sensor is possible where the sensor is just located at one side of the coin passage.

Figure 3:
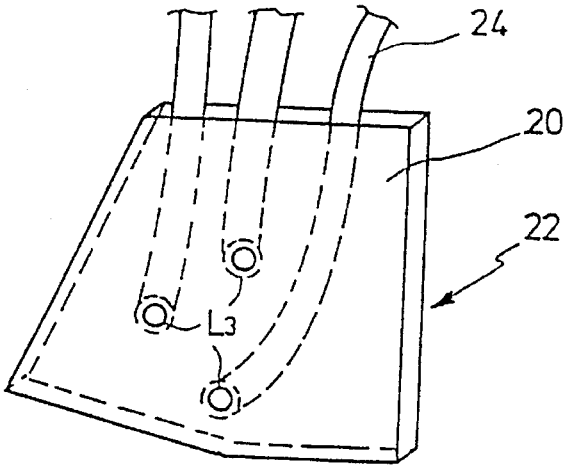

FIG. 1 further shows, how a flat casing 20 of a calibrating module 22 is inserted in the coin passage 16. The outer dimensions of the casing are such that it may be inserted with a little play, but in a relatively close fit. Means not shown hold the casing 20 in a predetermined position in the passage 16. The casing 20 encloses corefree coils L3, of which FIG. 1 shows a pair of such coils and FIG. 3 shows three. Each coreless coil L3 is associated to a pair of coils L1 and L2. The careless coils are connected through conduits 24 to a simulation generator not shown.

Figure 2:
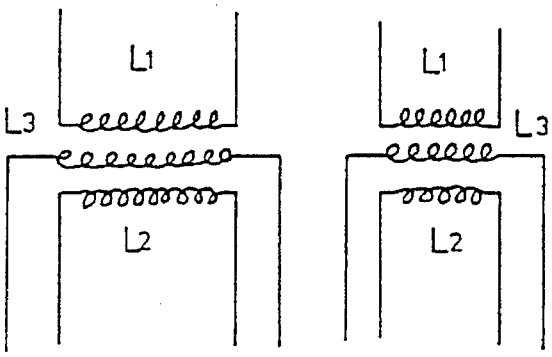

FIG. 2 shows the equivalent circuitry of a pair of coils L1, L2 and a coreless coil L3. The simulation generator produces a control signal for the air coils L3 simulating the passage of a coin through the electromagnetical field of the coils L1 and L2. The signal produced is an amplitude modulated signal, wherein the modulation time period is within the range of the passing time of the coins through the field of the coils L1 and L2. For the three coils L3, the temporary sequence of the signals to be applied to the individual air coils is selected such that it corresponds to the time sequence in which the coin passes the magnetical sensors.

Figure 4:
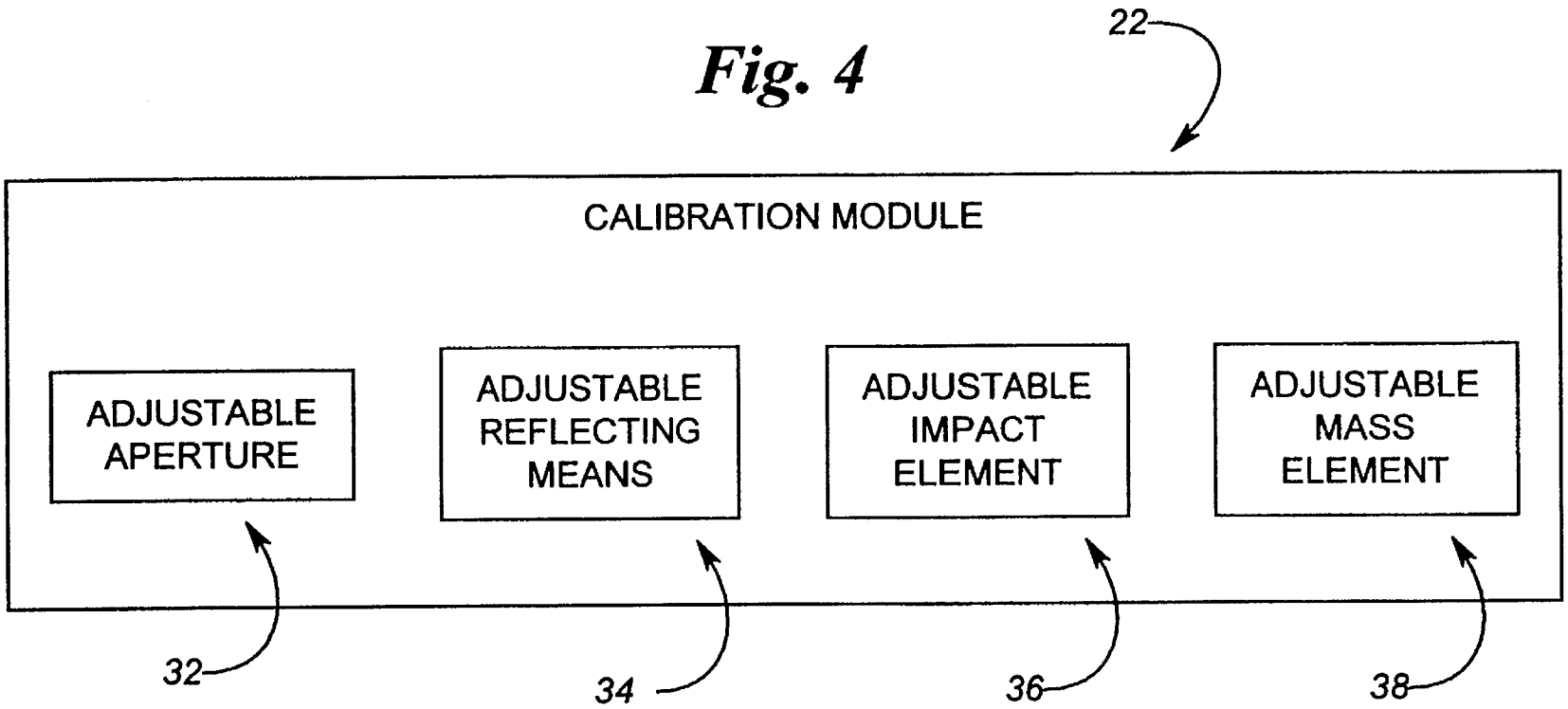

FIG. 4 shows a general block diagram of the calibrating module 22, which includes the simulation means. The simulation means may include either one or all of the following: an adjustable aperture 32; and adjustable reflecting means 34; an adjustable impact element 36; and an adjustable mass element 38.

What is claimed is:

1. A method for calibrating a coin checking device including at least one sensor, the method including the steps of inserting a calibrating module in a coin passing section accommodating all of said at least one sensor, generating sensor signals representing a physical feature of an acceptable coin by generating at least one measuring signal with the calibrating module, calculating a calibrating factor from the measuring signal determining at least one reference value from the sensor signals generated in the sensor, and storing said each reference value in a RAM memory of the coin checking device.

2. The method of claim 1, wherein the at least one measuring signal produced by the calibrating module is time responsive, and corresponds to the temporary course of the sensor signal produced by an acceptable coin.

3. The method of claim 1, wherein the calibrating module simulates a physical feature of an acceptable coin by providing the measuring signal, the magnitude of which corresponds to the physical feature.

4. The method of claim 1, wherein the calibrating module simulates a physical feature of an acceptable coin by providing the measuring signal, the magnitude of which is independent of the physical feature.

5. The method of claim 4, wherein a measuring value corresponding to the measuring signal is stored in a RAM memory of an external computing device, wherein correlation functions corresponding to acceptable coins are stored in the RAM memory of the external computing device and wherein the computing device calculates the reference value for a desired acceptable coin from the measuring value by means of one of said correlation functions, and wherein the reference value is then stored in the RAM memory of the coin checking device.

6. The method of claim 1, wherein the coin checking device has more than one sensor, and wherein a measuring signal is generated for each of the sensors.

7. The method of claim 6, wherein the measuring signal has a temporary course which approximately corresponds to a coin's time interval, wherein the time interval is the period in which a coin passes the sensors.

8. A calibrating device for calibrating a coin checking device accepting at least a coin, said coin checking device comprising at least one sensor and a coin passage section, wherein each sensor is associated with the coin passage section and generates a sensor signal representing a physical feature of a coin running in said passage section, the coin checking device further comprising a RAM memory in which at least a reference value is loaded which corresponds to said sensor signal, the calibrating device comprising a calibrating module which is inserted in said passage section in a predetermined position, wherein the calibrating module includes at least a simulation means which simulates said physical feature and interacts with the sensor, and the calibrating device further comprises a simulation generator, wherein the simulation generator is connected to the simulating means, delivering a control signal to the simulation means.

9. The device of claim 8, wherein the simulation generator is externally located with respect to the coin passage section and is connected to the calibrating module via electrical conductors.

10. The device of claim 8, wherein the configuration of the simulation means in said passage section corresponds to that of the sensor.

11. The device of claim 8, wherein the simulation means is adjustable.

12. The device of claim 8, wherein the calibrating module has outer dimensions to properly fit in the coin passage section.

13. The device of claim 8, wherein the simulation means comprises at least a magnetic, coreless coil to generate an electromagnetical field.

14. The device of claim 13, wherein the simulation generator generates a plurality of differing signal shapes having various frequencies and amplitudes.

15. The device of claim 13, wherein the control signal is amplitude modulated and the modulation period is within the range of a passing time of an acceptable coin, which is defined by the time interval in which the coin passes the sensors.

* * * * *